US006276446B1

(12) United States Patent
Kratz et al.

(10) Patent No.: US 6,276,446 B1
(45) Date of Patent: Aug. 21, 2001

(54) RECOOLING SYSTEM

(75) Inventors: Gerhard Kratz, Rodgau; Rudolf Lehmann, Egelsbach; Siegfried Münch, Alsbach, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/096,228

(22) Filed: Jun. 11, 1998

Related U.S. Application Data

(63) Continuation of application No. PCT/DE96/02298, filed on Nov. 29, 1996.

(30) Foreign Application Priority Data

Dec. 11, 1995 (DE) ..... 195 46 188

(51) Int. Cl.[7] ..... F28F 9/26
(52) U.S. Cl. ..... 165/144; 165/145
(58) Field of Search ..... 165/110, 144, 165/145

(56) References Cited

U.S. PATENT DOCUMENTS

| | | | | |
|---|---|---|---|---|
| 803,220 | * | 10/1905 | Farnsworth | 165/143 |
| 974,598 | * | 11/1910 | Reimers | 165/144 X |
| 1,103,386 | * | 7/1914 | Vail | 165/144 |
| 4,168,030 | | 9/1979 | Timmerman . | |
| 4,476,070 | | 10/1984 | Blanquet . | |

FOREIGN PATENT DOCUMENTS

| | | |
|---|---|---|
| 2356505 A1 | 5/1975 | (DE) . |
| 26 05 527 | 8/1977 | (DE) . |

* cited by examiner

*Primary Examiner*—Allen Flanigan
(74) *Attorney, Agent, or Firm*—Herbert L. Lerner; Laurence A. Greenberg; Werner H. Stemer

(57) ABSTRACT

A recooling system for cooling water from a condenser of a steam power plant includes a number of cooling modules, each of which can be fed through a water-feed shaft allocated thereto. The water-feed shafts are connected to one another like communicating tubes and are connected through a common main cooling-water line to the condenser. Such a recooling system can be installed and operated in an especially simple manner.

4 Claims, 2 Drawing Sheets

RECOOLING SYSTEM

CROSS-REFERENCE TO RELATED APPLICATION

This application is a continuation of International Application No. PCT/DE96/02298, filed Nov. 29, 1996, which designated the United States.

BACKGROUND OF THE INVENTION

Field of the Invention

The invention relates to a recooling system for cooling water from a condenser of a steam power plant.

A steam power plant is normally used to generate electric energy or even to drive a machine. In that case, a working medium, normally a water/steam mixture, carried in an evaporator circuit of the steam power plant is evaporated in an evaporator. The steam generated in the process expands to perform work in the steam turbine of the steam power plant and is then fed to the condenser thereof. The working medium condensed in the condenser is then fed to the evaporator again through a feedwater pump.

The working medium in the condenser is normally condensed by heat exchange with cooling water which is fed to the condenser and heats up in the process. The heated cooling water is in turn normally cooled in a recooling system by heat exchange with the ambient air. The cooled cooling water is then available again for cooling the condensate.

The recooling system normally includes a number of cooling towers. Allocated to each cooling tower is a catch basin which is connected to a collecting passage and in which cooled cooling water is collected. The recooled cooling water is fed back from there into the condenser through a condenser pump. Such a recooling system as a rule is adapted to the conditions of the power station site and therefore requires considerable outlay in terms of construction and layout. In addition, a complicated individual level control for the water level of each catch basin is required for such a recooling system.

SUMMARY OF THE INVENTION

It is accordingly an object of the invention to provide a recooling system for cooling water from a condenser of a steam power plant, which overcomes the hereinaforementioned disadvantages of the heretofore-known systems of this general type and which can be installed and operated in an especially simple manner.

With the foregoing and other objects in view there is provided, in accordance with the invention, a recooling system for cooling water from a condenser of a steam power plant, comprising a number of cooling modules; water-feed ducts each associated with a respective one of the cooling modules for feeding the cooling modules, the water-feed ducts connected to one another like communicating tubes; and a common main cooling-water line for connecting the water-feed shafts to a condenser of a steam power plant.

The invention starts out from the concept that the installation cost for the recooling system is reduced by standardized components. When standardized components or modules are used for the recooling system, it can be adapted like a unit construction system to the respective power station plant.

In addition, the recooling system can be especially simple to operate if an individual level control for each water-collecting basin that is allocated in each case to a cooling module is replaced by a level control which is common to all of the water-collecting basins. A level control that is common to all of the water-collecting basins can be achieved by a central water supply which is constructed for all of the cooling modules in such a way that a variation in the cooling-water inflow to a cooling module leaves the cooling-water inflow to the other cooling modules more or less unchanged. Such a structure can be achieved by the water-feed ducts being connected to one another according to the principle of communicating tubes. The term "communicating tubes" is defined, for example, in the book entitled "Duden: Das groβbe Wö rterbuch der Deutschen Sprache" [Duden: The Large Dictionary of the German Language], volume 5 (1980), Bibliographisches Institut Mannheim.

Thus, according to the principle of communicating tubes, the level of a liquid in tubes that are connected to one another and open at the top is the same in each tube. The water-feed ducts of all of the cooling modules therefore have the same water level so that the inflow of cooling water to all of the cooling modules can be centrally controlled. An especially simple and reliable water-level control, namely with the aid of the operating conditions prevailing in the condenser as well as through the use of the delivery capacity of the cooling-water pump, can be achieved in this case by the water-feed ducts connected to one another being connected to the condenser through a common main cooling-water line.

In accordance with another feature of the invention, in order to uncouple the cooling-water inflow to a cooling module from the cooling-water inflow to the other cooling modules in an especially simple manner, a water overflow is connected to the water supply, and the water overflow is connected on the outlet side to a water return. Therefore, a constant water level is maintained in each water-feed duct in an especially simple manner even when the pressure conditions in the water supply vary. The operating conditions for each cooling module are therefore at least more or less independent of the cooling-water conditions in the condenser and of the operating state of the condenser pump.

In accordance with a concomitant feature of the invention, each water-feed duct can be shut off through the use of an intake fitting allocated thereto. The water intake to each cooling module can therefore be controlled with especially simple measures. During maintenance or repair work on a cooling module, its water intake can be interrupted in a simple manner, with the water overflow serving as a bypass for the cooling-water flow that is then in excess. Thus the water intake into the other cooling modules is unchanged even when a cooling module is shut off. Therefore, a complicated level control in the collecting basins of the cooling modules is not necessary even when one or more cooling modules are shut off.

The advantages achieved by the invention are in particular the fact that, on one hand, the recooling system, due to its modular structure, can be adapted like a unit construction system to a predetermined power station concept in an especially flexible manner, in which case standard components may be used. On the other hand, the recooling system is also especially flexible during operation due to the structure of the water-feed shafts, which are connected to the condenser of the steam power plant like communicating tubes through a common main cooling-water line.

During varying operating conditions, for example when switching over from summer to winter operation, varying demands are made on the recooling system. In that case, the total flow of the cooling water to be cooled can be split up into a first partial flow which is cooled in cooling modules and a second partial flow which is fed back directly into the water return through the water overflow, like a bypass, without cooling. In the process, the operation of each cooling module and of the entire recooling system can be maintained even during the use of unregulated cooling-water pumps within the tolerances predetermined for this recooling system without a complicated level control.

Other features which are considered as characteristic for the invention are set forth in the appended claims.

Although the invention is illustrated and described herein as embodied in a recooling system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
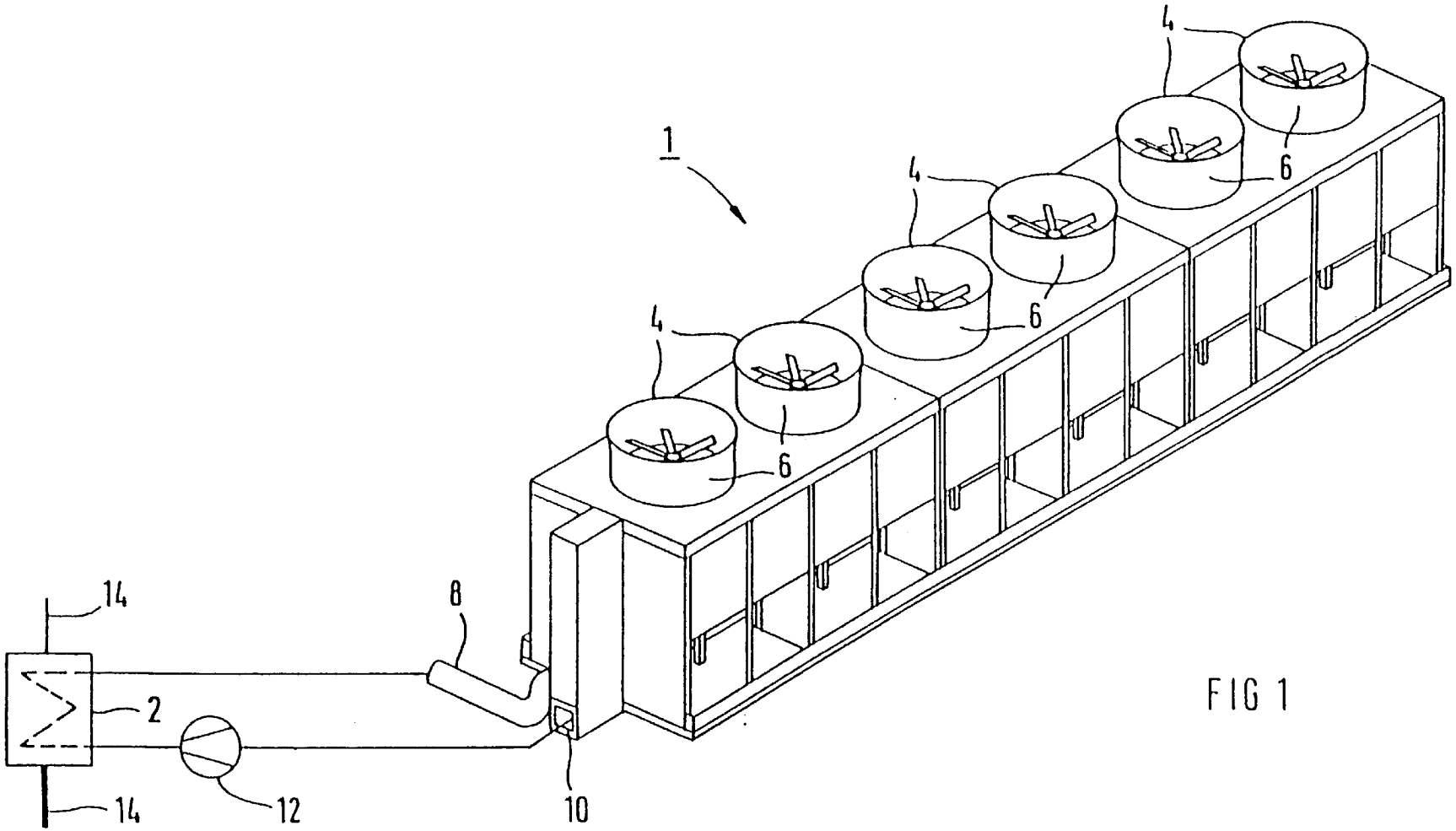
FIG. 1 is a diagrammatic, perspective view of a recooling system for cooling water from a condenser of a steam power plant, having a number of cooling modules.

DESCRIPTION OF THE PREFERRED EMBODIMENTS:

Referring now in detail to the figures of the drawings, in which the same parts are provided with the same reference numerals, and first, particularly, to FIG. 1 thereof, there is seen a recooling system 1 for cooling water from a condenser 2 of a steam power plant (that is not shown in greater detail) which includes a number of cooling modules 4. In this configuration, a fan 6 is allocated to each cooling module 4.

The cooling modules 4 are connected to the condenser 2 through a main cooling-water line 8 on a cooling-water inlet side and through a cooling-tower return passage 10 and a cooling-water pump unit 12 on a cooling-water outlet side. The condenser 2 is connected on the primary side in a diagrammatically indicated water/steam cycle 14 of the steam power plant.

The cooling modules 4 are standardized with regard to their dimensions and rain area. An adaptation to specific requirements of the steam power plant is possible in an especially simple manner by a suitable selection and combination of the cooling modules 4. Thus FIG. 1 shows a series configuration of the cooling modules 4. Alternatively, however, other configurations are also possible, for example in pairs or in block form.

Figure 2:
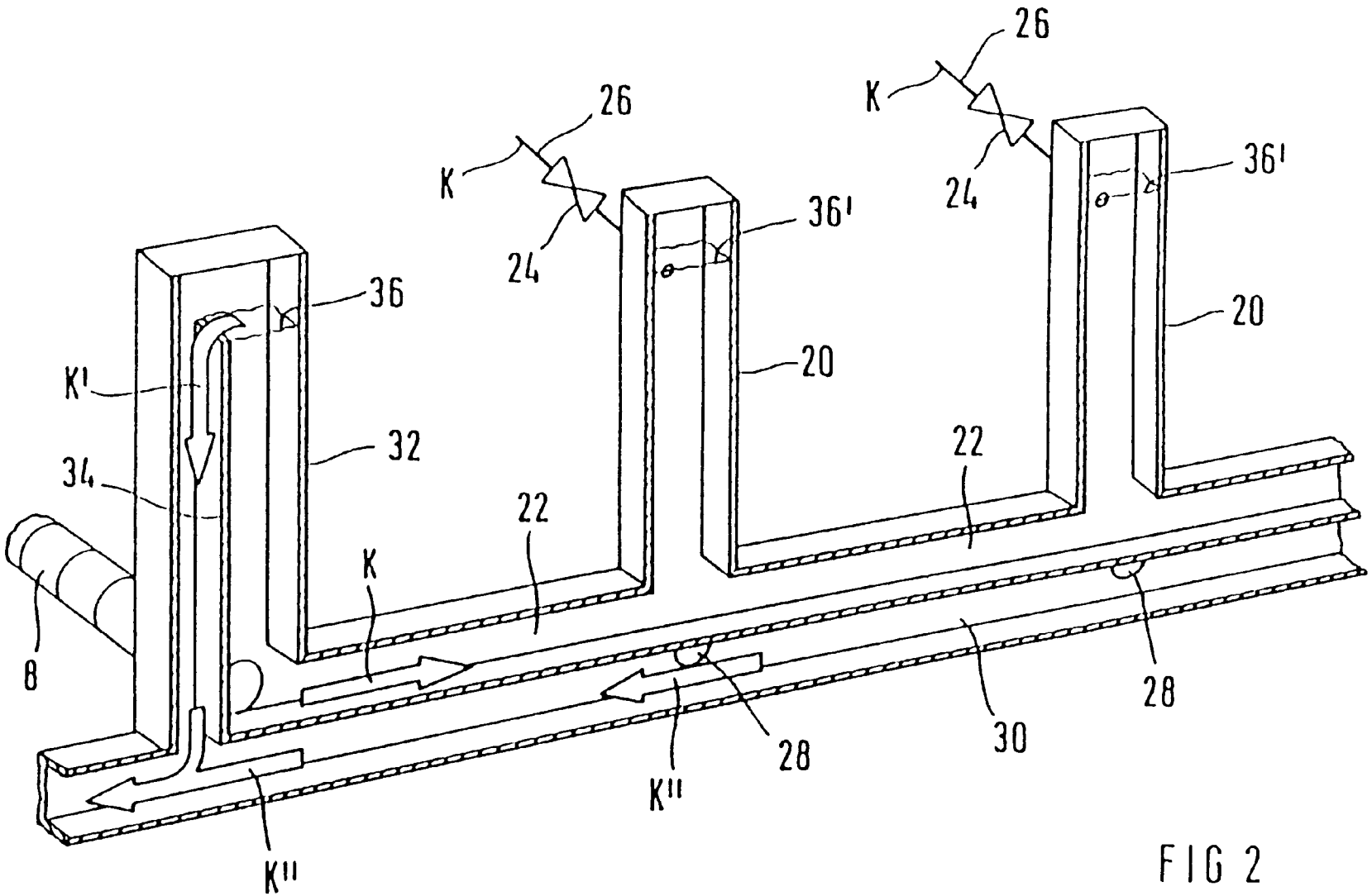
FIG. 2 is a fragmentary, perspective, sectional view of a water supply for the recooling system according to FIG. 1.

A water-feed duct 20 according to FIG. 2 is allocated to each cooling module 4. The water-feed ducts 20 are connected to the main cooling-water line 8 which is common to them. In this configuration, the water-feed ducts 20 are connected both to one another through a water-feed passage 22 and to the condenser 2 of the steam power plant through the main cooling-water line 8 like communicating tubes. A water-distribution line 26 which can be shut off by an intake fitting 24 branches off from each water-feed duct 20. Cooling water K can be fed from the condenser 2 of the steam power plant through the main cooling-water line 8 and the feed passage 22, as well as through the water-distribution line 26, to the cooling module 4 allocated to the respective water-feed duct 20.

Each cooling module 4 is connected on the cooling-water outlet side through a non-illustrated collecting basin allocated to it and through a basin drain duct 28, to the cooling-tower return passage 10 which is common to all of the cooling modules 4. The cooling-tower return passage 10 is in turn connected through the cooling-water pump unit 12 to the condenser 2. A water overflow 32 which is connected to the main water line 8, is connected on the outlet side to the cooling-tower return passage 10. A weir wall 34 disposed in the water overflow 32 ensures that a constant water level 36 is maintained in the water overflow 32 and thus a constant water level 36' is also maintained at the same height in each water-feed duct 20 which is connected to the water overflow 32 like communicating tubes. In the event of overfeeding through the main cooling-water line 8, a partial cooling-water quantity K' which cannot be directed to the cooling modules 4 flows over the weir wall 34 of the water overflow 32 and is therefore directly admixed to cooled cooling-water K" flowing in the cooling-tower return passage 10. Therefore the water overflow 32 acts like a bypass to prevent overfeeding of the water-feed ducts 20 and the water-distribution lines 26 of the cooling modules 4.

A cooling module 4 can be shut off through the use of the intake fitting 24 allocated to it, such as for maintenance or repair work on the cooling module 4, so that the inflow of cooling water K to be cooled is prevented. In this case, the partial cooling-water quantity K' of the uncooled cooling water admixed to the cooled cooling water K" through the water overflow 32 increases accordingly. However, the inflow of cooling water K to be cooled leading to the cooling modules 4 which have not been shut off remains unchanged due to the unchanged water level 36' in the water-feed ducts 20 that are allocated to these cooling modules 4 in each case. Therefore, no complicated level control or inflow control in the other cooling modules 4 is necessary even when a cooling module 4 is shut off.

The recooling system 1 can therefore be adapted to different requirements in an especially simple manner. Through the use of the intake fittings 24, the ratio of recooled cooling water K to the partial cooling-water quantity K' which has not been recooled can be varied in an especially simple manner and can therefore be adapted to different operating conditions of the steam power plant. In particular, the recooling system 1 of the steam power plant can therefore be used in an especially flexible and simple manner when switching over from summer to winter operation.

With regard to the structural nature of the recooling system 1, various types of construction are possible for the cooling modules 4. In particular, the latter may be constructed in a timber type of construction, a steel-frame type of construction or even a reinforced concrete type of construction.

We claim:

1. A recooling system for cooling water from a condenser of a steam power plant, comprising:

a number of cooling modules;

water-feed ducts each associated with a respective one of said cooling modules for feeding said cooling modules;

an unvalved water overflow, said unvalved water overflow and said water-feed ducts connected to one another like communicating tubes; and a common main cooling-water line for connecting said communicating water-feed ducts and said unvalved water overflow to a condenser of a steam power plant.

2. The recooling system according to claim 1, including a cooling-tower return passage, and wherein said water overflow has an outlet side connected to said cooling-tower return passage.

3. The recooling system according to claim 1, including intake fittings each associated with a respective one of said water-feed ducts for shutting off said water-feed ducts.

4. A recooling system for cooling water from a condenser of a steam power plant, comprising:

a number of cooling modules;

water-feed ducts each associated with a respective one of said cooling modules for feeding said cooling modules, said water-feed ducts connected to one another like communicating tubes;

a condenser of a steam power plant;

a common main cooling-water line for connecting said water-feed ducts to said condenser.

* * * * *